US006499942B1

(12) United States Patent
Nonaka et al.

(10) Patent No.: US 6,499,942 B1
(45) Date of Patent: Dec. 31, 2002

(54) TURBOMOLECULAR PUMP AND VACUUM APPARATUS

(75) Inventors: Manabu Nonaka, Narashino (JP); Takashi Okada, Narashino (JP); Takashi Kabasawa, Narashino (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/444,431

(22) Filed: Nov. 19, 1999

(30) Foreign Application Priority Data

Nov. 24, 1998 (JP) ..... 10-349382

(51) Int. Cl.[7] ..... F04D 19/04

(52) U.S. Cl. ..... 415/90; 415/193; 415/208.2; 415/209.1; 415/210.1; 416/237; 416/242; 416/243

(58) Field of Search ..... 415/90, 143, 189–191, 415/193–194, 208.2, 209.1, 209.2, 210.1; 416/235, 237, 242, 243; 417/423.4

(56) References Cited

U.S. PATENT DOCUMENTS

| | | | | | |
|---|---|---|---|---|---|
| 4,822,251 | A | * | 4/1989 | Amrath et al. | 415/90 |
| 5,062,271 | A | * | 11/1991 | Okumura et al. | 415/90 |
| 5,513,499 | A | * | 5/1996 | deRijke | 415/90 |

FOREIGN PATENT DOCUMENTS

| | | | | | |
|---|---|---|---|---|---|
| EP | 0256739 | | 2/1988 | | |
| EP | 0829645 | | 3/1998 | | |
| FR | 1374182 | A | * | 8/1964 | 416/243 |
| GB | 1019272 | | 2/1966 | | |
| JP | 57-191492 | | 11/1982 | | |
| JP | 61-25993 | | 2/1986 | | |

OTHER PUBLICATIONS

Patent Abstracts of Japan, vol. 007, No. 041 (M–194), Feb. 18, 1983.

* cited by examiner

*Primary Examiner*—Christopher Verdier
(74) *Attorney, Agent, or Firm*—Adams & Wilks

(57) ABSTRACT

A turbomolecular pump capable of maintaining a maximum discharge rate even in a higher pressure has rotor blades or stator blades formed such that surface angles on a first surface of the blades facing the direction of rotation differ between an inlet port side of the blades and an outlet port side. The surface closer to the inlet port has a larger angle than on a side closer to the outlet port. One side of the blades has a plurality of surface portions each with different angles. The angles of the surfaces are in the range of 20° to 50° on the inlet port side, 10° to 40° on an intermediate portion, and 10° to 90° on the outlet port side. The angles of the first and second surface portions are larger than that of the intermediate surface portion.

10 Claims, 9 Drawing Sheets

FIG.8A ←
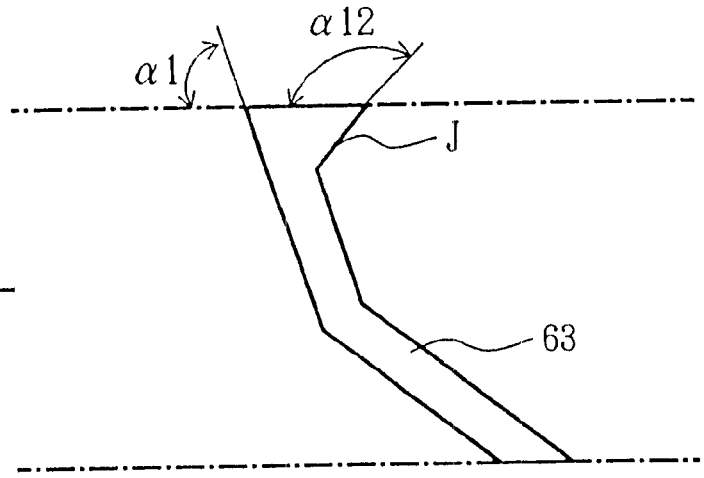
FIG.8B ←
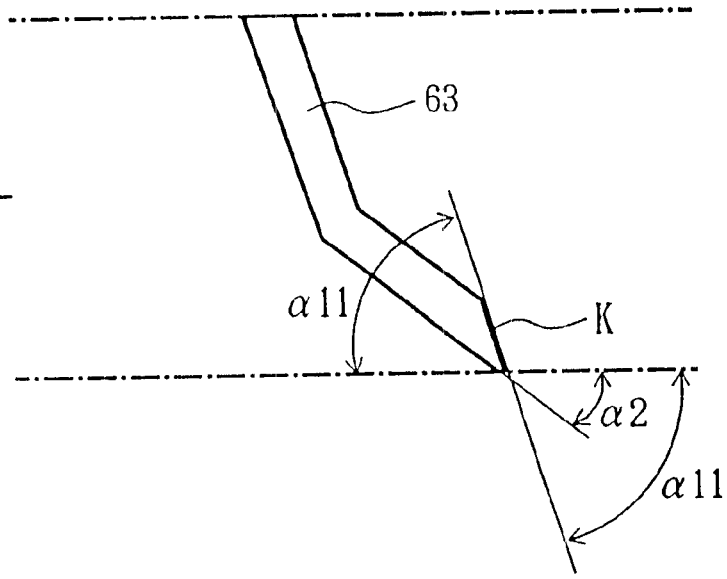

TURBOMOLECULAR PUMP AND VACUUM APPARATUS

BACKGROUND OF THE INVENTION

1. Field of the Invention

The present invention relates to a turbomolecular pump and a turbomolecular pump or vacuum apparatus, and more specifically to a turbomolecular pump and a turbomolecular pump apparatus, which are used as a vacuum apparatus semiconductor manufacturing equipment, an electron microscope or the like.

2. Description of the Related Art

In a case where dry etching, CVD, etc. are performed upon manufacturing a semiconductor or liquid crystal device, a turbomolecular pump apparatus is employed to suck and/or discharge a process gas, which is supplied into a chamber, by means of a turbomolecular pump.

The turbomolecular pump has stator blades and rotor blades which are alternately disposed to provide pairs of the rotor blades and the stator blades in a multistage arrangement. The rotor blades are disposed on a rotor axis that is rotated at high speed, and the stator blades are fixed to a casing.

The rotor blade at each stage includes blades (vanes) provided radially with the inlet port side being tilted toward a traveling direction (direction of rotation). The stator blade at each stage includes blades (vanes) provided radially which are tilted in an opposite direction to the blades of the rotor blade.

The rotor blades impart momentum to gas molecules for delivering them toward the outlet port, and the gas molecules thus transferred are obliquely reflected by the tilted surfaces of the blades of the stator blade, thereby gradually being transferred to the subsequent stage. In such a manner, the gas molecules are sequentially fed from the inlet port side to the outlet port side by the rotor and stator blades at the respective stages, to thereby carry out the discharge.

FIG. 10 is a view showing a sectional configuration of the blades of rotor blades and stator blades in such a gas molecular area.

As shown in FIG. 10, blades 1*a* of the rotor blade and blades 2*a* of the stator blade on the inlet port side are respectively formed to have an angle (elevation angles) A of from 30 degrees to 50 degrees with respect to the traveling direction in order to take in the more gas molecules to thereby increase a suction amount thereof.

On the other hand, an elevation angle B of each blade at the outlet port side is set to 25 degree or lower so that it is possible to prevent the gas from reverse-flowing even if the gas pressure rises and mean free distance becomes short.

In other words, the blades 1*a*, 2*a* at the inlet port side have a larger tilt angle, while the blades 1*b*, 2*b* at the outlet port side have a smaller tilt angle.

In addition, as shown in FIG. 10, the blades at any stages are shaped to have a parallelogram in cross-section in an axial direction. The surfaces of blades that impart the momentum to the gas molecules are planar.

However, as the volume of gas molecules to be discharged is increased, the pressure within the turbomolecular pump is increased with the result that the mean free distance of molecule becomes short. In this case, both blades 1*a*, 2*a* on the intake port side, which are specialized their functions to take in the amount of sucking gas, undergo an increased leakage reverse flow of the gas, resulting in lower efficiency. Namely, the exhaust rate is lowered.

Also, in case of the blades 1*b*, 2*b* at the outlet port side which specialize in their sealing property (prevention of reverse flow), on the premise that the blades 1*a*, 2*a* at the inlet port side have such an effect that the volume of the gas molecules to be taken in is increased, their discharge efficiency is not lowered but the discharge rate is not enhanced. Hence, in the entire pump in which these blades are stacked, the pump performance will be remarkably deteriorated with an increase of the exhaust gas.

SUMMARY OF THE INVENTION

Therefore, the present invention has been made in view of the foregoing drawbacks, and has an object of the present invention to provide a turbomolecular pump capable of maintaining a maximum exhaust rate even in a higher pressure.

According to the present invention, there is provided a turbomolecular pump comprising a rotor shaft, a bearing for rotatably supporting the rotor shaft, a motor for driving the rotor shaft supported by the bearing, a rotor body which is disposed on the rotor shaft, rotor blades in a multistage arrangement disposed on the rotor body, the rotor blades each including a plurality of blades extending in a radial direction, and stator blades in a multistage arrangement respectively located between the rotor blades in multistage arrangement, the stator blades each including a plurality of blades extending in a radial direction, wherein a sectional configuration in an axial direction of the blades of one of the rotor blades and the stator blades is formed so that a side facing the travelling direction of the blades includes a plurality of surfaces having different angles, and the surface facing the travelling direction of the blades has an angle on the inlet port side larger than the angle on the outlet port side.

According to the present invention, in a sectional configuration of the blades, a difference between the angles formed by the end surfaces in the plurality of surfaces is 5° or more.

According to the present invention, the angles of the surfaces in the sectional configuration of the blades are in a range of 20° to 50° on the inlet port side, and in a range of 10° to 40° on the outlet port side, respectively.

According to the present invention, the angles of the surfaces in the sectional configuration of the blades are in a range of 20° to 50° on the inlet port side, in a range of 10° to 40° on the intermediate part, and in a range of 10° to 90° on the outlet port side, respectively.

According to the present invention, in the sectional configuration of the blades, the surfaces on the back side to the travelling direction of the blades include the same angle as that of the surfaces on the front side.

According to the present invention, in the sectional configuration of the blades, at least one of the surfaces on the back side to the travelling direction of the blades includes the angle different from that of the surfaces on the front side.

According to the present invention, in the sectional configuration of the blades on the inlet port side, the surfaces on the back side to the travelling direction of the blades include an angle which is larger by 5° or more than that of the surfaces on the front side.

According to the present invention, in the sectional configuration on the outlet port side of the blades, the surfaces on the back side to the travelling direction of the blades include the angle which is larger by 5° or more than that of the surfaces on the front side.

According to the present invention, a thread groove pump section is arranged on the outlet port side subsequent to a turbomolecular pump section having the rotor blades and the stator blades.

According to the present invention, there is provided a vacuum apparatus comprising a turbomolecular pump according to the present invention as described above, and a vacuum container connected to an inlet port of the turbomolecular pump, for sucking/discharging gas inside thereof.

That is, according to the present invention, the blades of the rotor blade and the stator blade at each stage are shaped so that the performance involving the elevation angles emphasizing a range from the amount of sucking gas to the capability of preventing the reverse flow can be exerted in the blades at one stage.

As described above, the present invention is so arranged to realize the double effect to increase the amount of sucking gas and to prevent the reverse flow in the blades at one stage. Accordingly, the turbomolecular pump can maintain its maximum discharge rate at a higher pressure.

Further, even if the mean free distance of gas is not larger than the height of the blade (e.g., not larger than 20 nm), the effect involving the suction and the discharge can be obtained in the blades at one stage.

BRIEF DESCRIPTION OF THE DRAWINGS

In the accompanying drawings:

FIGS. 8A and 8B are explanatory diagrams showing the cross sections of the blades of the rotor blade in the axial direction in accordance with other modification examples;

DETAILED DESCRIPTION OF THE PREFERRED EMBODIMENTS

Preferred embodiments of the present invention will now be described in detail with reference to FIGS. 1 to 9.

Figure 1:
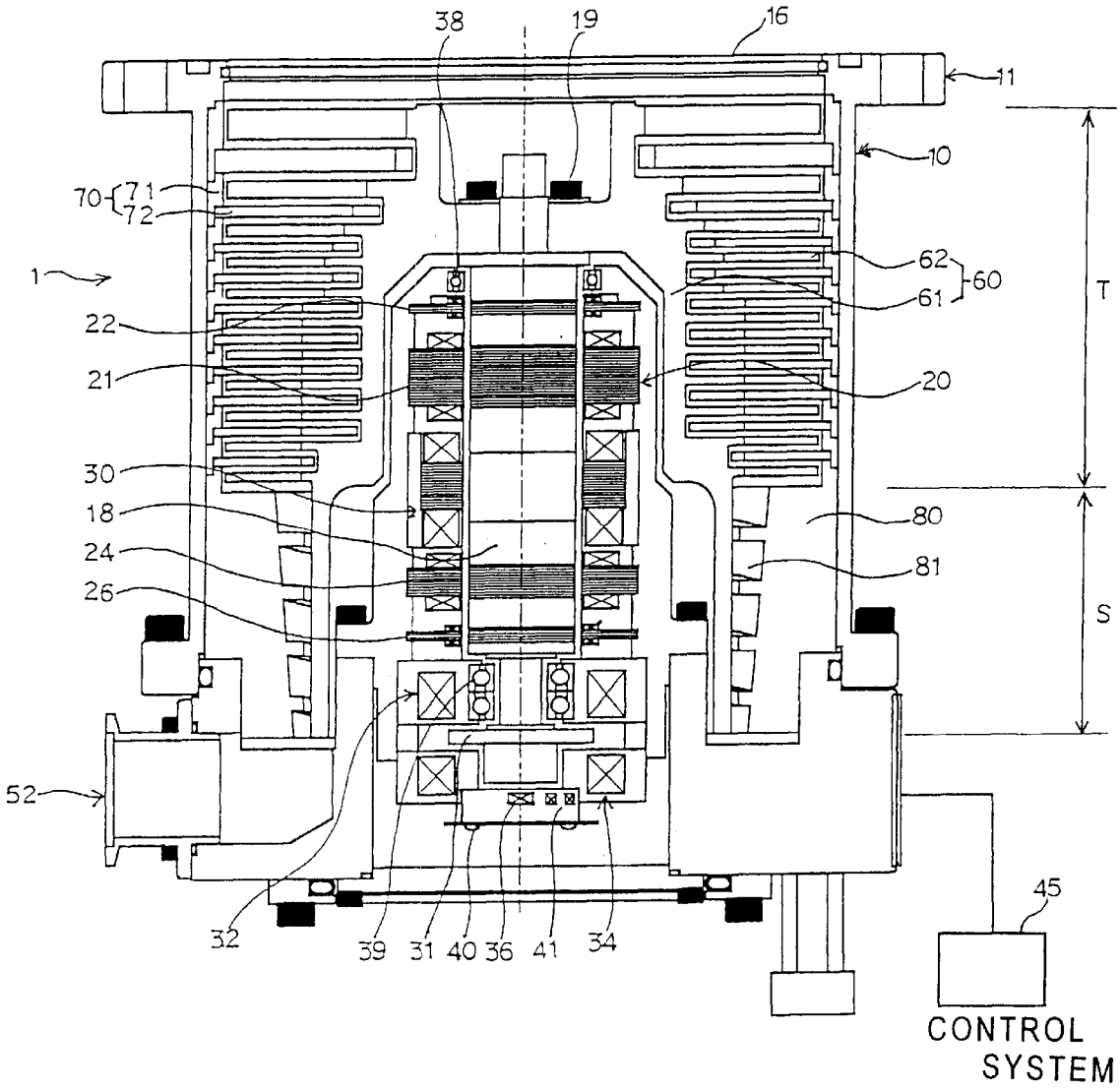
FIG. 1 is a cross-sectional view showing the entire structure of a turbomolecular pump according to an embodiment of the present invention.

FIG. 1 is a cross-sectional view showing the entire structure of a turbomolecular pump according to an embodiment of the present invention.

A turbomolecular pump 1 is arranged in, for example, semiconductor manufacturing equipment or the like, and is used to discharge a process gas from a chamber etc. The turbomolecular pump 1 comprises a turbomolecular pump section T and a thread groove pump section S. The turbomolecular pump section T is adapted to supply a process gas from a chamber etc. toward the downstream side by means of stator blades 72 and rotor blades 62. The thread groove pump section S is adapted to further deliver and discharge the process gas supplied from the turbomolecular pump section T by means of a thread groove pump.

As shown in FIG. 1, the turbomolecular pump 1 includes: an outer casing 10 having a substantially tubular shape; a rotor shaft 18 having a substantially cylindrical shape, which is located at the center of the outer casing 10; a rotor 60; and a stator 70. The rotor 60 is fixedly disposed to the rotor shaft 18 and rotated in association with the rotor shaft 18.

A flange 11 is formed on the top end of the outer casing 10, extending outwardly in a radial direction. The flange 11 is secured to the semiconductor manufacturing equipment or the like with bolts etc. so that an inlet port 16 formed inside the flange 11 may be connected to a discharge port of a container such as a chamber to communicate the inner portion of the container and the inner portion of the outer casing 10 with each other.

The rotor 60 comprises a rotor body 61 having a substantially inverted U-shape in cross-section, which is arranged around the circumference of the rotor shaft 18. The rotor body 61 is attached to the top of the rotor shaft 18 with bolts 19. In the turbomolecular pump section T, the rotor body 61 is formed with rotor blades 62 in a multistage arrangement.

Figure 2:
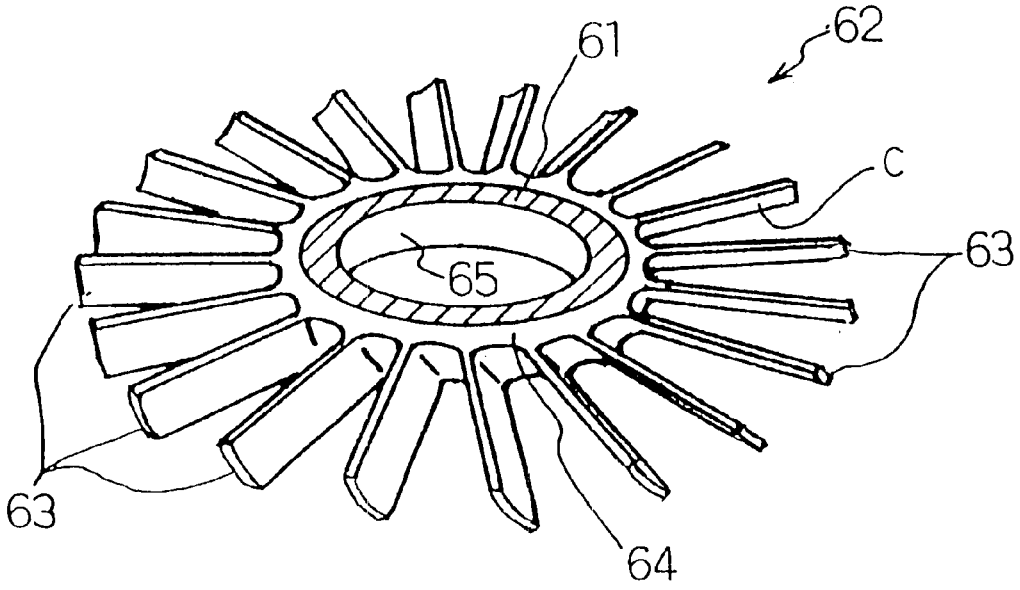
FIG. 2 is a cross-sectional perspective view of a rotor in the turbomolecular pump of FIG. 1, taken along the upper and lower surfaces of a rotor blade.

FIG. 2 is a cross-sectional perspective view of the rotor 60, taken along the upper and lower surfaces of the rotor blade 62.

Referring to FIG. 2, each rotor blade 62 is composed of a rotor annular portion 64 and a plurality of blades (vanes) 63. The rotor annular portion 64 is annularly mounted to the circumference of the rotor body 61. The blades 63 are arranged radially in a radial direction at an equal interval on the circumference of the rotor annular portion 64.

The blades 63 are tilted in the direction of rotation at the inlet port side (upper side in the figure). The blades are arranged so that a blade surface C which strikes the gas molecules at the outlet port side (lower side in the figure) has a larger elevation angle at the inlet port side than an elevation angle at the outlet port side, as will be described later.

In the turbomolecular pump section T, the stator 70 includes spacers 71, and stator blades 72 that are disposed between the rotor blades 62 at the respective stages while the outer circumferences thereof are held between the spacers 71 and 71. In the thread groove pump section S, a thread groove spacer 80 adjoining to the spacers 71 is included.

The spacers 71 have a tubular shape with stepped portions and are stacked inside the outer casing 10. The length of the stepped portions in the axial direction positioned inside the spacers 71 corresponds to the intervals between the respective steps for the rotor blades 62.

Figure 3:
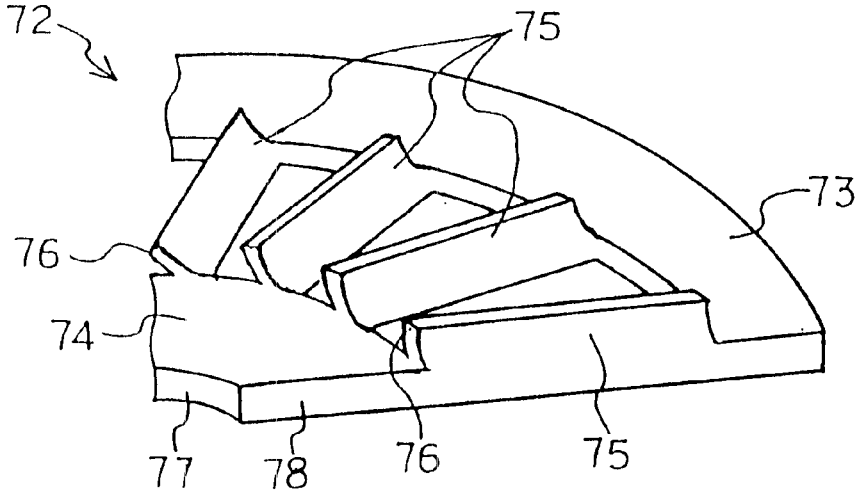
FIG. 3 is a perspective view showing a part of a stator blade in the turbomolecular pump of FIG. 1.

FIG. 3 is a perspective view showing a part of each stator blade 72.

The stator blade 72 is composed of an outer annular portion 73 a part of which is sandwiched by the spacers 71 in the circumferential direction, an inner annular portion 74, and a plurality of blades 75 that are radially arranged between the inner and outer annular positions. Each of the blades 75 has both ends supported at a predetermined angle by the outer annular portion 73 and the inner annular portion 74, respectively. The inner diameter of the inner annular portion 74 is larger than the outer diameter of the rotor body 61 so that the inner peripheral surface 77 of the inner annular portion 74 may not be brought into contact with the outer peripheral surface 65 of the rotor body 61.

The stator blade 72 adopts a shape circumferentially divided into two in order to be suited for an arrangement between the rotor blades 62 at the respective stages. For example, a thin plate made of a stainless steel or aluminum is divided into two, from which a half-annular outer portion and portions corresponding to the blades 75 of the stator blade 72 are removed by etching etc. The portions corresponding to the blades 75 are then bent to have a predetermined angle by press-machining. Thus, the stator blade 72 with a shape shown in FIG. 3 can be obtained.

As shown in FIG. 3, the blades 75 of the stator blade 72 are tilted in the orientation opposite to the blades 63 of the rotor blade 62, in which the elevation angle at the inlet port side are larger than the elevation angle at the outlet port side, as will be described later.

In the stator blade 72 at each stage, the outer annular portion 73 thereof are circumferentially sandwiched by the stepped portions between the spacers 71 and 71, thereby being held between the rotor blades 62.

Back to FIG. 1, the thread groove spacer 80 is disposed in communication with the spacers 71, and provided beneath the spacers 71 and the stator blades 72. The thread groove spacer 80 is thickened so that the inner diameter wall extends to the position close to the outer peripheral surface of the rotor body 61. A plurality of thread grooves 81, each having a spiral structure, are formed on the inner diameter wall. The thread grooves 81 are communicated with the space between the stator blades 72 and the rotor blades 62 so that the gas delivered and discharged may be supplied into the thread grooves 81.

In the present embodiment, the thread grooves 81 are formed at the side of the stator 70. However, the thread grooves 81 may be formed on the outer diameter wall of the rotor body 61. Alternatively, the thread grooves 81 may be formed on the thread groove spacer 80, and also be formed on the outer diameter wall of the rotor body 61.

In addition, the turbomolecular pump 1 is equipped with a magnetic bearing 20 for supporting the rotor shaft 18 with a magnetic force, and a motor 30 for producing a torque at the rotor shaft 18.

The magnetic bearing 20 is a magnetic bearing of a five-shaft control type, equipped with radial electromagnets 21 and 24 for producing a magnetic force in the radial direction with respect to the rotor shaft 18, radial sensors 22 and 26 for detecting the position of the rotor shaft 18 in the radial direction, axial electromagnets 32 and 24 for producing a magnetic force in the axial direction to the rotor shaft 18, an armature disk 31 on which a magnetic force in the axial direction caused by the axial electromagnets 32 and 34 acts, and an axial sensor 36 for detecting the position of the rotor shaft 18 in the axial direction.

The axial electromagnet 21 is composed of two pairs of electromagnets arranged to be orthogonal to each other. The respective pairs of electromagnets are arranged at position over the motor 30 of the rotor shaft 18 in a face-to-face manner while sandwiching the rotor shaft 18.

Disposed above the radial electromagnets 21 are two pairs of the radial sensors 22 facing each other and sandwiching the rotor shaft 18. Two pairs of the radial sensors 22 are arranged to be orthogonal to each other in correspondence with two pairs of the radial electromagnets 21.

In addition, two pairs of the radial electromagnetics 24 orthogonal to each other are also disposed beneath the motor 30 of the rotor shaft 18.

Two pairs of the radial sensors 26 adjacent to the radial electromagnets 24 are also provided beneath the radial electromagnets 24.

When an excitation current is supplied to these radial electromagnets 21 and 24, the rotor shaft 18 can be magnetically floated. This excitation current is controlled in response to a position detection signal from the radial sensors 22 and 26, to thereby hold the rotor shaft 18 at a predetermined position in the radial direction.

The armature disk 31 that has a disk shape and is made of a magnetic material is fixed to the lower portion of the rotor shaft 18. One pair each of the axial electromagnets 32 and 34 facing each other are arranged so as to sandwich the armature disk 31. The axial sensor 36 is also arranged, facing the lower end of the rotor shaft 18.

An excitation current supplied to these axial electromagnets 32 and 34 is controlled in response to a position detection signal from the axial sensor 36, to thereby hold the rotor shaft 18 at a predetermined position in the axial direction.

The magnetic bearing 20 is equipped with a magnetic bearing control section within the control system 45. The magnetic bearing control section separately feed-back controls the excitation current supplied to the radial electromagnets 21 and 24, the axial electromagnets 32 and 34 and the like based on the detection signals from the radial sensors 22 and 26 and the axial sensor 36. As a result, the rotor shaft 18 can be magnetically floated.

The turbomolecular pump in accordance with the present embodiment can be driven in a clean condition without any concern with dust or undesired gas. This is because the use of the magnetic bearing eliminates the presence of a mechanical contact to generate no dust, or no requirement for sealing oil or the like prevents undesired gas from generating. Such a turbomolecular pump meets with a high cleanness requirement for manufacturing semiconductors and the like.

In the turbomolecular pump 1 in accordance with the present embodiment, protective bearings 38 and 39 are provided on the top and bottom sides of the rotor shaft 18, respectively.

In general, the rotor section composed of the rotor shaft 18 and components equipped therewith is axially supported by the magnetic bearing 20 in a non-contact manner with the stator section while being rotated by the motor 30. The protective bearings 38 and 39 are bearings that serve to protect the whole apparatus by supporting the rotor section in place of the magnetic bearing 20 if abnormal displacement of the rotor causes touchdown due to any external shock and the like.

Accordingly, the protective bearings 38 and 39 are so arranged that the inner race of each bearing may not be brought into contact with the rotor shaft 18.

The motor 30 is disposed substantially at the center position in the axial direction of the rotor shaft 18 between the radial sensor 22 and the radial sensor 26 within the outer casing 10. An electrical conduction of the motor 30 allows the rotor shaft 18, and the rotor 60 fixed thereto, and rotor blades 62, to be rotated. The rpm of the rotation is detected by an rpm sensor 41, and then controlled by the control system 45 based on the signal sent from the rpm sensor 41.

An outlet port 52 for discharging the gas delivered by the thread groove pump section S to the outside is arranged in the lower portion of the outer casing 10 in the turbomolecular pump 1.

Further, the turbomolecular pump 1 is connected to the control system 45 via a connector and a cable.

Figure 4A:
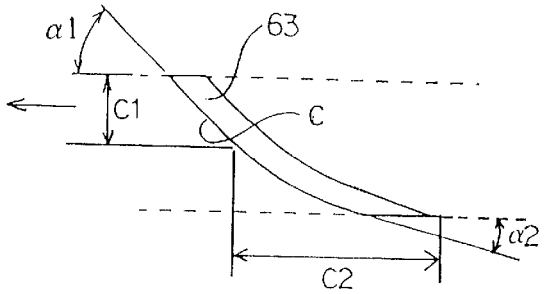
FIGS. 4A and 4B are explanatory diagrams showing cross-sections of the blades of the rotor blade and the blades of the stator blade in the axial direction.
Figure 4B:
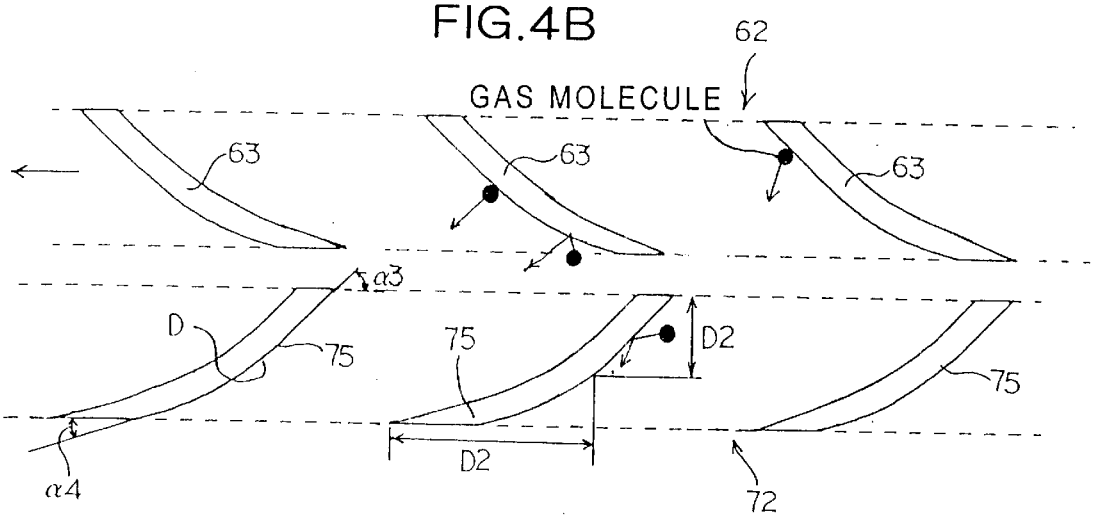

FIGS. 4A and 4B show cross-sections of the blades 63 of the rotor blade 62 and the blades 75 of the stator blade 72 in the axial direction.

Referring to FIG. 4A, if the blades 63 of the rotor blade run in the direction indicated by an arrow of this figure, the inlet port side (upper side in the figure) is tilted toward the running direction.

If a blade surface C facing the outlet port side and strikes gas molecules has an elevation angle (a tangent angle) of $\alpha 1$ on the inlet port side, and an elevation angle (a tangent angle) of $\alpha 2$ on the outlet port side, the values that meet the following conditions (1) to (3) are then selected.

$$20° \leqq \alpha 1 \leqq 50° \quad (1)$$

$$10° \leqq \alpha 2 \leqq 45° \text{ (preferably, } 40°) \quad (2)$$

$$(\alpha 1 - \alpha 2) \geqq 5° \quad (3)$$

In the above conditions, therefore, the elevation angle of $\alpha 1$ on the inlet port side is increased and the elevation angle of $\alpha 2$ on the outlet port side is decreased in the blades 63 of the rotor blade in each one stage. In this case, within the blade surface C, the inlet port side surface C1 primarily serves to increase the amount of sucking gas and the outlet port side surface C2 primarily serves to prevent the reverse flow of the gas molecules and to perform the gas compression.

FIG. 4B is a cross sectional view showing both blades 63 and 75 of the rotor blade 62 and the stator blade 72, respectively.

If each blade 75 of the stator blade 72 also has a blade surface D facing the outlet port side where an elevation angle (a tangent angle) on the inlet port side is set as $\alpha 3$, and an elevation angle (a tangent angle) on the outlet port side is set as $\alpha 4$, the values that meet the following conditions (4) to (6) are then selected.

$$10° \leqq \alpha 3 \leqq 50° \quad (4)$$

$$10° \leqq \alpha 4 \leqq 45° \text{ (preferably, } 40°) \quad (5)$$

$$(\alpha 3 - \alpha 4) \geqq 5° \quad (6)$$

Noted that in the present embodiment, the respective elevation angles of the blades 63 of the rotor blade 62 and the blades 75 of the stator blade 72 in the same stage have relations of $\alpha 1 = \alpha 3$ and $\alpha 2 = \alpha 4$. However, it may be acceptable to set as $\alpha 1 \neq \alpha 3$ and $\alpha 2 \neq \alpha 4$.

Further, the values of the elevation angles of $\alpha 1$ and $\alpha 2$ of the blades 63 of the rotor blade 62 and the elevation angles of $\alpha 3$ and $\alpha 4$ of the blades 75 of the stator blade 72 may be different every stage. For example, it is assumed that the respective stages fall into the upstream stage, midstream stage and downstream stage. In this case, the values of the elevation angles of $\alpha 2$, $\alpha 4$ at the midstream stage are made smaller than those at the upstream stage and also larger than those at the downstream stage, thereby being capable of obtaining smaller elevation angles at the downstream stage where the prevention of the reverse flow is more required.

The stator blade 72 has the outer peripheral surface held by the spacers 71, as previously described. Hence, the blades 75 of the stator blade 72 are prevented from rotating to impart the momentum to gas molecules as the blades 63 of the rotor blade 62 do. However, the blade surface D of the blades 75 of the stator blade 72 functions to reflect the gas molecules to which the momentum is imparted by the blades 63 of the rotor blade 62 toward the outlet port side.

Then, by the surface D1 on the inlet port side, the volume of the gas molecules to be taken in is secured in principle, whereas the reverse flow is prevented from occurring by the surface D2 on the outlet port side in principle.

The gas molecules indicated by the black circle in FIG. 4B, which obtain the downward momentum (toward the outlet port) by the blades 63 of the rotor blade 62, travel and then are reflected downwardly by the blades 75 of the stator blade 72 to be exhausted into the subsequent stage.

Accordingly, the rotor blades 62 and the stator blades 72 secure the amount of gas drawn into the pump and prevent the reverse flow at every stage. As a result, a maximum exhaust rate can be maintained even in a higher internal pump pressure.

Now, a description will be given of preferred embodiments of the vacuum apparatus in accordance with the present invention that employs the turbomolecular pump 1 according to the foregoing embodiment.

Figure 5:
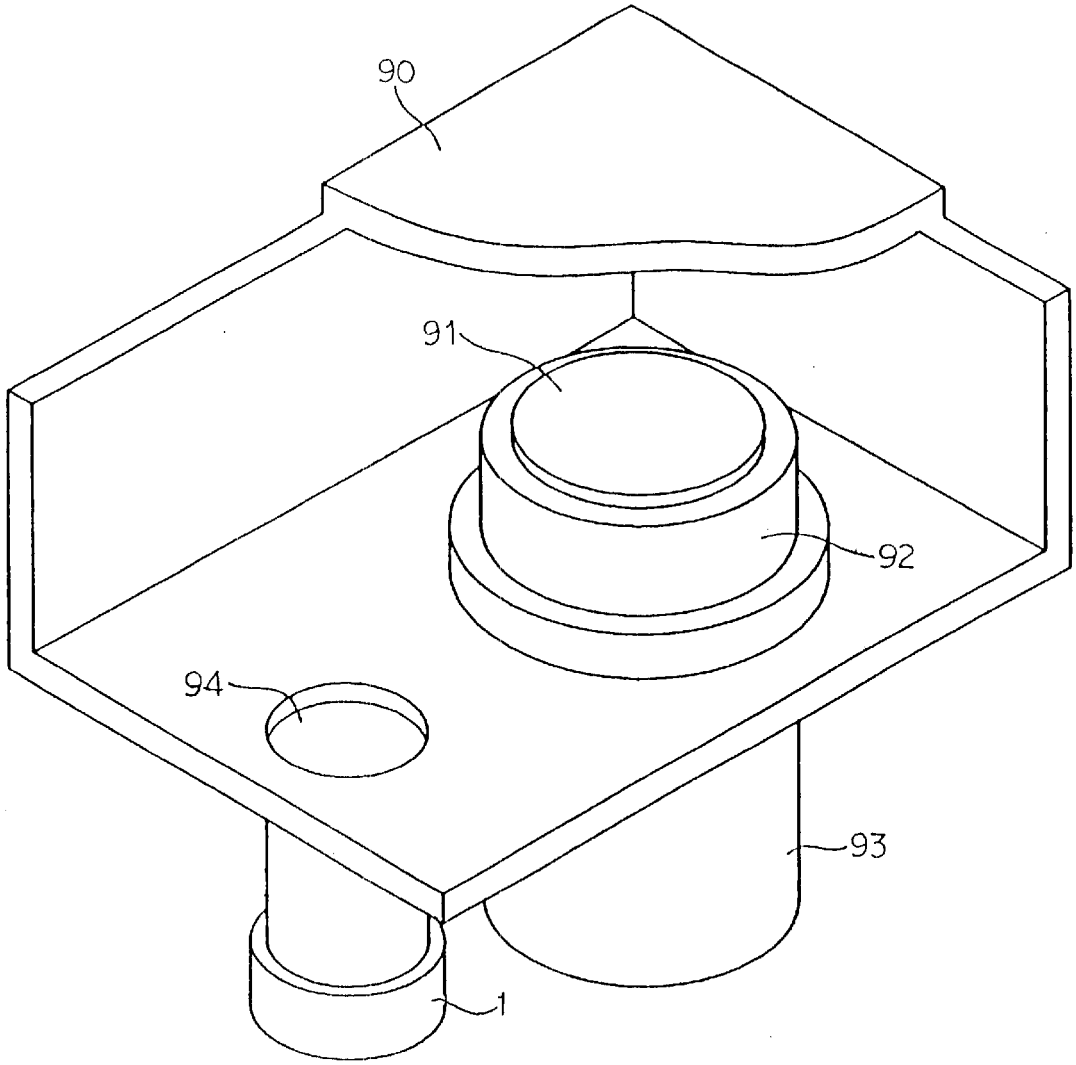
FIG. 5 is a structural view showing a vacuum apparatus to which the turbomolecular pump of FIG. 1 is connected.

FIG. 5 is a schematic perspective view showing the structure of the vacuum apparatus in accordance with an embodiment of the present invention.

As is apparent from FIG. 5, the vacuum apparatus according to the present embodiment includes a stage 92 on which a sample 91 or the like is placed and a driver mechanism 93 for driving the stage 92 to rotate, etc. The stage 92 is disposed inside a chamber (container) 90. The driver mechanism 93 is disposed beneath the stage 92 outside the chamber 90.

A discharge port 94 is formed in the lower surface (or side surface) of the chamber. The turbomolecular pump 1 is fitted into the discharge port 94 from the outside of the chamber 90 so that gas within the chamber 90 may be exhaused.

In the turbomolecular pump 1 and the vacuum apparatus constructed in the above manner, when the rotor 60 is rotated at the rated value as high as 20,000 to 50,000 rpm by the motor 30, the rotor blade 62 may be also rotated at a high speed. This operates the rotor blades 62 and the thread grooves 81 to deliver and discharge a process gas within the chamber 90 from the outlet port 52 through the discharge port 94 and the inlet port 16 of the turbomolecular pump 1.

In this connection, in the turbomolecular pump section T, the blades 63 of the rotor blade 62 and the blades 75 of the stator blade 72 at each stage can realize both functions to secure the amount of sucking gas and to prevent the reverse flow at their own stage. Therefore, a maximum exhaust rate can be maintained even in a higher pressure.

In addition, the exhaust is carried out by the turbomolecular pump section T, followed by the exhaust with the thread groove pump section S. Therefore, the turbomolecular pump 1 can be utilized even in a higher pressure.

Now, a description will be given of a first modification example of the blades 63 of the rotor blade 62 and the blades 75 of the stator blade 72 in the turbomolecular pump.

Figure 6A:
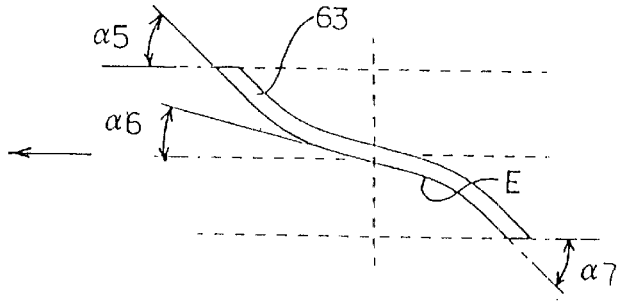
FIGS. 6A and 6B are explanatory diagrams showing the cross sections of the blades of the rotor blade and the blades of the stator blade in the axial direction in accordance with a first modification example.
Figure 6B:
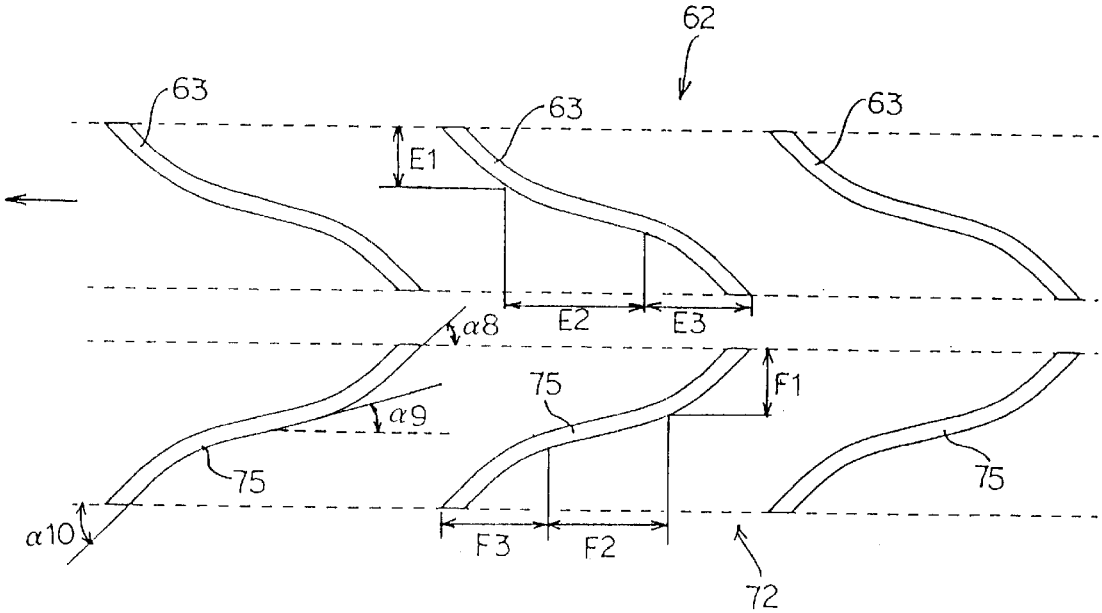

FIGS. 6A and 6B show the cross-section of the blades 63 or blade 62 and the blades 75 of the stator blade 72 to the first modification example.

Referring to FIG. 6A, a blade surface E of each blade 63 or the rotor blade 62 which serves to impart the momentum to gas molecules is tilted at three stages, i.e., the inlet port side, intermediate part side and outlet port side.

If an elevation angle on the inlet port side is set as $\alpha 5$, an elevation angle on the intermediate part is set as $\alpha 6$, and an elevation angle on the outlet port side is set as $\alpha 7$, the values that meet the following conditions (7) to (11) are then selected.

$$10° \leqq \alpha 5 \leqq 50° \quad (7)$$

$$10° \leqq \alpha 6 \leqq 45° \text{ (preferably, } 40°) \quad (8)$$

$$(\alpha 5 - \alpha 6) \geqq 5° \quad (9)$$

$$10° \leqq \alpha 7 \leqq 90° \quad (10)$$

$$(\alpha 7 - \alpha 6) \geqq 5° \quad (11)$$

In this first modification example, the elevation angle of $\alpha 5$ on the inlet port side is increased, the elevation angle of $\alpha 6$ on the intermediate part is decreased, and the elevation angle of $\alpha 7$ on the outlet port side is again increased in the blades 63 of the rotor blade 62 in each one stage. In this case, within the blade surface E, the inlet port side surface E1 primarily serves to increase the amount of sucking gas, the intermediate part surface E2 primarily serves to prevent the reverse flow of the gas molecules and to perform the gas compression, and the outlet port side surface E3 primarily serves to direct the flow of the gas molecules to the outlet port side.

Referring now to FIG. 6B, each blade 75 of the stator blade 72 also has a blade surface smoothly tilted at three stages, similar to the blades 63 of the rotor blade 62, i.e., an inlet port side surface F1, an intermediate part surface F2, and an outlet port side surface F3, into a continuous curved surface facing the outlet port side. Then, if elevation angles at the respective surfaces are set to $\alpha 8$, $\alpha 9$, and $\alpha 10$, respectively, the values that meet the following conditions (12) to (16) are then selected.

$$10° \leqq \alpha 8 \leqq 50° \quad (12)$$

$$10° \leqq \alpha 9 \leqq 45° \text{ (preferably, } 40°) \quad (13)$$

$$(\alpha 8 - \alpha 9) \geqq 5° \quad (14)$$

$$10° \leqq \alpha 10 \leqq 90° \quad (15)$$

$$(\alpha 10 - \alpha 9) \geqq 5° \quad (16)$$

The surfaces F1, F2 and F3 of the blades 75 of the stator blade 72 have the same functions as those of the surfaces E1, E2 and E3 of the blades 63 of the rotor blade 62.

According to the first modification example, the outlet port side surfaces E3, F3 can further direct the movement of gas molecules to the outlet port side, while the exhaust rate can be further improved.

A second modification example will now be described.

Figure 7A:
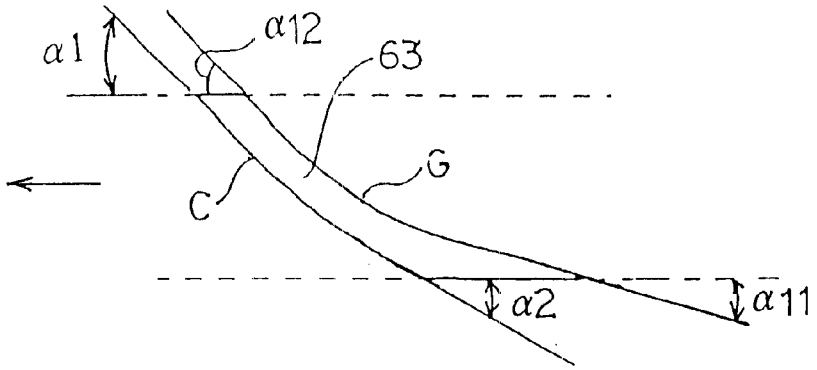
FIGS. 7A to 7C are explanatory diagrams showing the cross sections of the blades of the rotor blade in the axial direction in accordance with other modification examples.
Figure 7B:
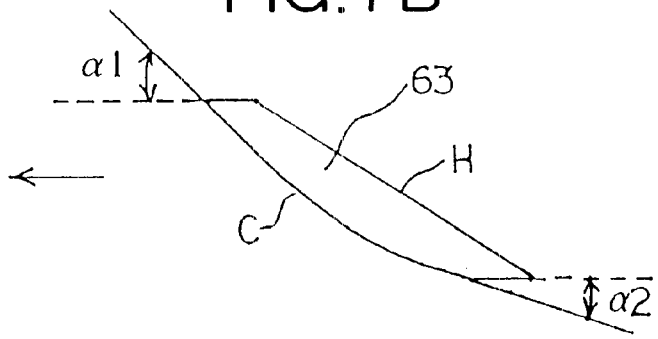
Figure 7C:
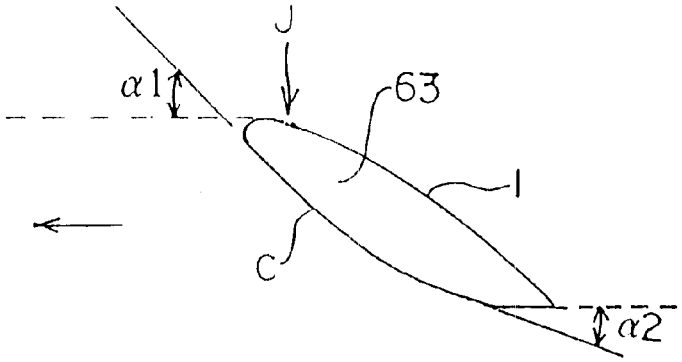

FIGS. 7A to 7C show the cross-section of the blades 63 of the rotor blade 62 according to another modification example.

In each modification example shown in FIGS. 7A to 7C, the blade surface C is tilted in the same manner as that of the blade surface C in accordance with the first embodiment (the same elevation angles al, $\alpha 2$). However, blade surfaces G, H and I at the back of the surface C differ from one another in sectional configuration. While FIGS. 7A to 7C refer to the blades 63 of the rotor blade 62, it will be appreciated that the same is true for the configuration of the blades 75 of the stator blade 72.

In the modification example shown in FIG. 7A, the elevation angle of all on the outlet port side in the blade surface G is smaller than the elevation angle of $\alpha 2$ of the blade surface C. As shown in this modification example, if $\alpha 11 < \alpha 2$ is established, an area of the bottom surface C2 facing the outlet port side can be made larger, so that the bottom surface C2 can prevent the reverse flow of gas molecules from the outlet port side. If this modification example is applied to the blades 63 of the rotor blade 62 which is rotatively traveling, a larger effect can be attained rather than applying to the blades 75 of the stator blade 72 which is not rotatively travelling.

While the modification example employs the elevation angle of $\alpha 12$ on the inlet port side which is the same as the elevation angle of $\alpha 1$, the values meeting $\alpha 12 \neq \alpha 1$ may be selected. Similarly, $\alpha 11 > \alpha 2$ may be acceptable.

In a modification example shown in FIG. 7B, the blade surface H is made plane.

In addition to the effect obtained from the first embodiment with the use of the blade surface C, according to this modification example, since the blade surface H is made plane, the thickness of the blade can be increased. Also, the blades 63 of the rotor blade 62 can be enhanced in rigidity, and the machining thereof is also easy.

In a modification example shown in FIG. 7C, the blade surface I is curved toward the back side with respect to the rotation direction of the blade.

In addition to the effect obtained from the first embodiment with the use of the blade surface C, according to this modification example, the blades 63 of the rotor blade 62 can be further enhanced in rigidity with the blade surface I being curved outward.

Further, when gas to be exhausted by the turbomolecular pump is of a viscous flow before reaching a molecular flow, or when an increased gaseous pressure brings the gas into a viscous flow in the middle, the exhaust performance can still be improved. In other words, if the surface with respect to the gas molecules of viscous flow is curved inward on the back side in the travelling direction (e.g., blade surface G), or if it is planar (e.g., blade surface H), the gas may not travel along such blade surfaces (e.g., blade surface G or H) to the outlet port side, and then removed. According to the present modification example, however, since the blade surface I is curved outward, the gas molecules of viscous flow can be exhausted without removal.

Further, in the modification example shown in FIG. 7C, the top end I on the outlet port side is shaped into a round to have no discontinuous surface, so that the foregoing effects on the viscous flow can be more improved.

FIGS. 8A and 8B show the cross-section of the blades 63 of the rotor blade 62 in the axial direction according to still another modification example. While FIGS. 8A to 8B refer to the blades 63 of the rotor blade 62, it will be appreciated that the same is true for the configuration of the blades 75 of the stator blade 72.

In each of the modification examples shown in FIGS. 8A and 8B, the blade surfaces J and K on the back side of each blade 63 of the rotor blade 62 in the travelling direction have such an elevation angle that the reverse flow volume of gas molecules from the outlet port side may be reduced.

In the modification example shown in FIG. 8A, out of the blade surfaces on the back side of the blade 63 of the rotor blade 62, the blade surface J has an elevation angle of $\alpha 12$ on the inlet port side which is larger than the elevation angle of $\alpha 1$ on the front surface side by 5° or more. That is, the difference between the elevation angles is set as $\alpha 12 - \alpha 1 \geqq 5°$. However, when the elevation angle of $\alpha 12$ is set 90° or more as shown in FIG. 8A, a part of the gas molecules that are reflected by the back side of the blade 63 of the rotor blade 62 toward the inlet port side can be again directed to the outlet port side by the blade surface J of the back thereof. In the case where the present embodiment is applied to the blades 75 of the stator blade 72, the effect can be particularly exerted in which the gas molecules are again reflected by the blade surface J.

In FIG. 8B, out of the blade surfaces on the back side of the blade 63 of the rotor blade 62, the blade surface K has an elevation angle of $\alpha 2$ on the front surface side by 5° or more.

Like this, the difference between the elevation angles is set as $\alpha 11-\alpha 2 \geqq 5°$. When the gas molecules on the back side are reflected by the blade surface K, the volume of feeding the gas molecules to the inlet port (upward in this figure) can be reduced while the volume of horizontally feeding the gas molecules (rightward in this figure) can be large. Hence, the gas molecules once reflected by the blade surface K are travel to the front surface side of the blade 63 of the rotor blade 62 which is adjacent to the back side of the blade 63 of the rotor blade 62, where these are reflected. Then, these are exhausted to the outlet port side.

The foregoing effect can be more greatly exerted in the case where the present embodiment is applied to the blades 75 of the stator blade that is not rotatively traveling.

Although the embodiments have been described, the turbomolecular pump in accordance with the present invention and the vacuum apparatus in accordance with the present invention are not to be limited to the foregoing embodiments. Any modification and variation can be made without departing from the gist of the present invention.

For example, according to the foregoing embodiments, the gas delivery section is composed of the turbomolecular pump section T and the thread groove pump section S; however it is not limited thereto. For example, the gas delivery section may be composed of only the turbomolecular pump section T, or may be composed of the turbomolecular pump section T and other pump mechanism section represented by a centrifugal flow type pump and the like.

Figure 9:
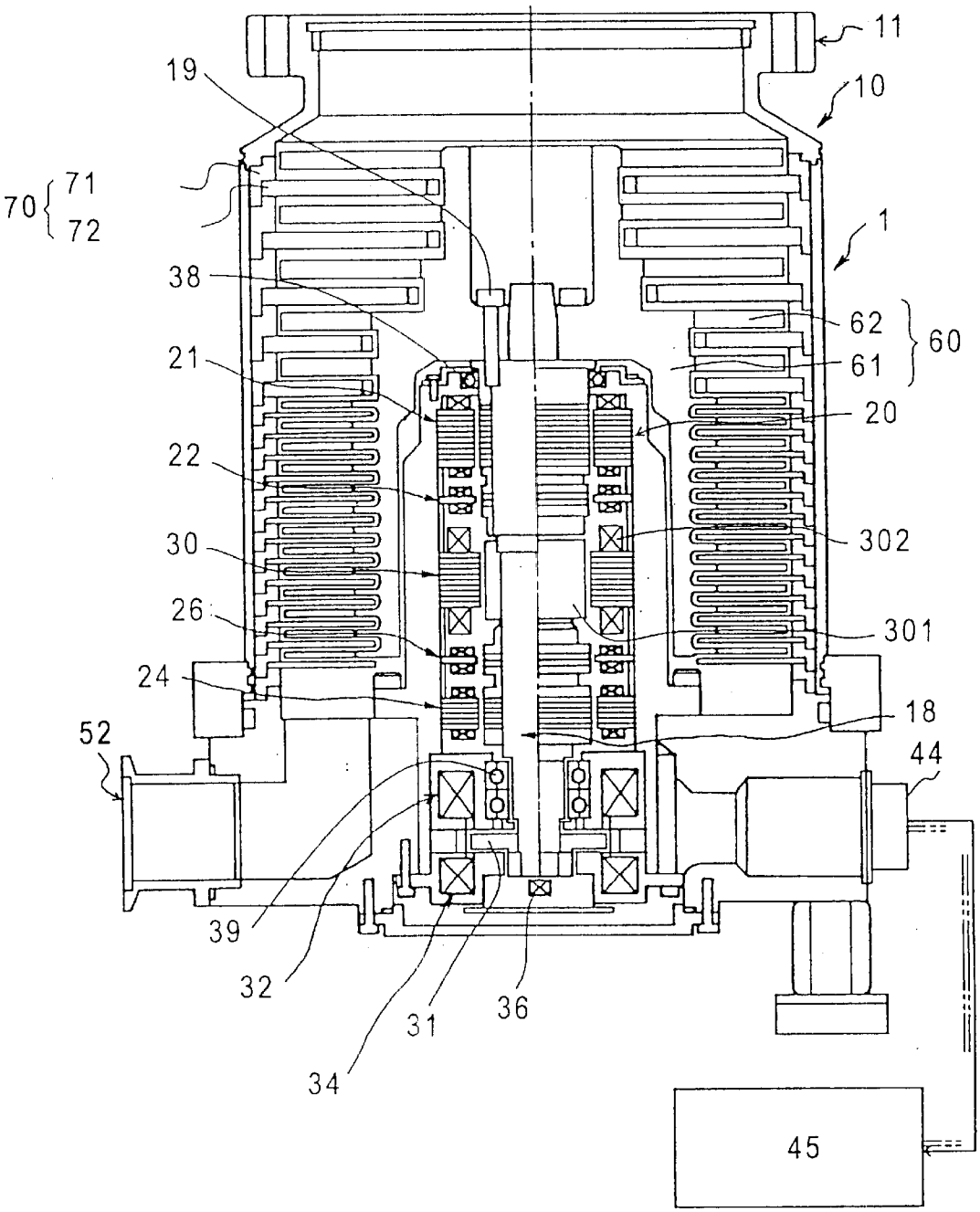
FIG. 9 is a view showing a cross-section of another structure of the turbomolecular pump.
Figure 10:
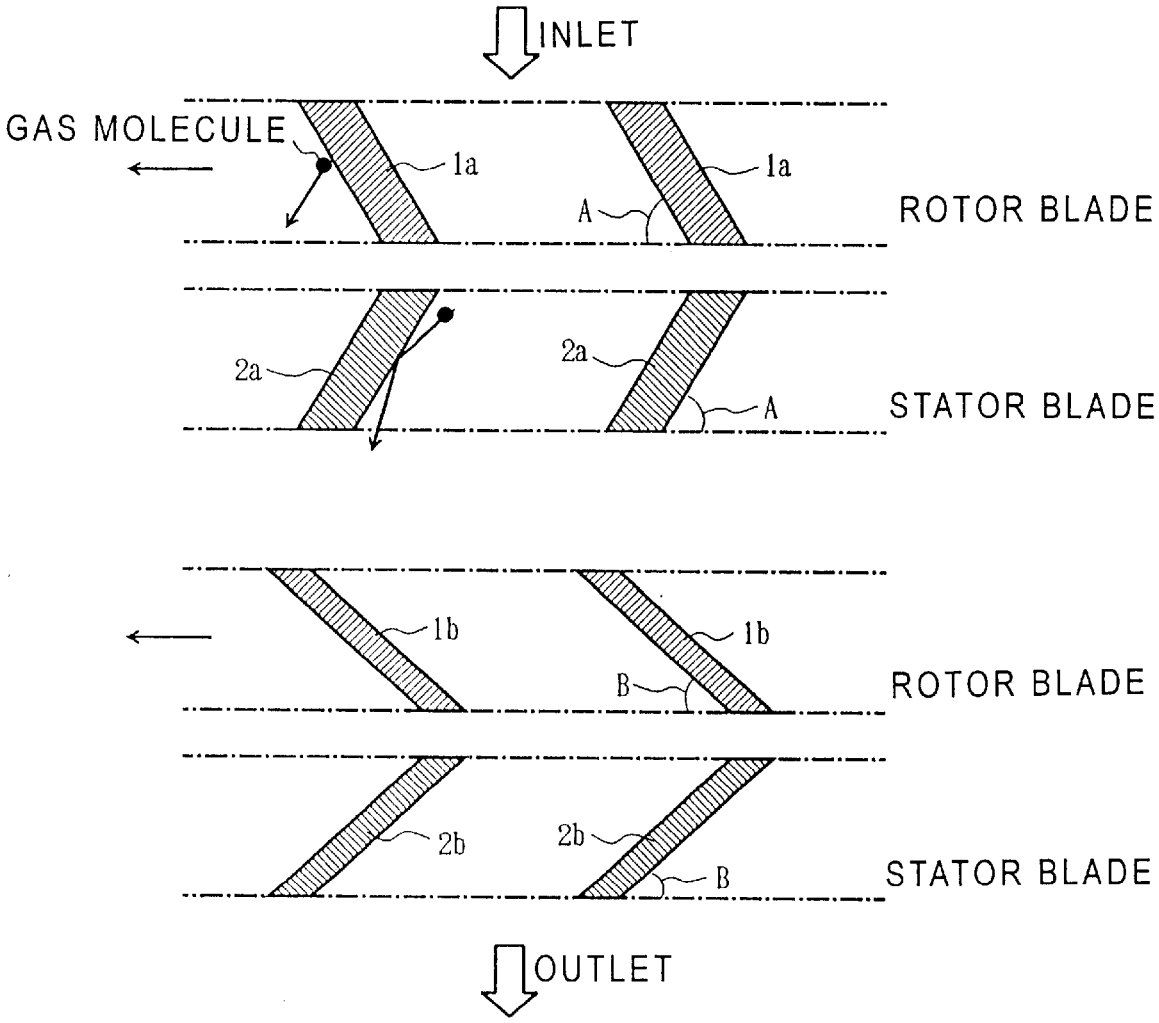
FIG.10 PRIOR ART
FIG. 10 is an explanatory diagram showing a sectional configuration of the blades of the rotor blade and the blades of the stator blade of the prior art.

FIG. 9 shows an alternative structure of the turbomolecular pump for discharging gas, which is composed of only the turbomolecular pump section. The same reference numerals are designated to the same elements of FIG. 1.

Accordingly, the turbomolecular pump including the rotor blades 62 and the stator blades 72 over the axial direction is employed, and the blades 63 of the rotor blade 62 and the blades 75 of the stator blade 72 having any of the structure shown in FIGS. 4, 6 and 7 are used at the respective stages or some of the stages. With such a structure, a maximum exhaust rate can be maintained at a higher pressure compared with the prior turbomolecular pump in which the both blade surfaces are planar and parallelogrammatic.

As stated in the foregoing description, in the turbomolecular pump and vacuum apparatus in accordance with the present invention, the sectional configuration in the axial direction of the blades of at least one of the rotor blade and the stator blade at least some of the stages is formed so that the elevation angle on the inlet port side is larger than the elevation angle on outlet port side on the blade surface facing the outlet port side, whereby a maximum exhaust rate can be maintained even in a higher pressure.

What is claimed is:

1. A turbomolecular pump comprising: an inlet port into which a gas is introduced; an outlet port from which the gas is expelled; a motor; a rotor having plural rotor blades and being rotatably driven by the motor for pumping the gas from the inlet port to the outlet port; a plurality of stator blades confronting the rotor blades with a small gap between confronting stator and rotor blades; a bearing for rotatably supporting the rotor; and a casing for housing the motor and the stator blades; wherein the rotor blades and the stator blades are oriented at a given angle with respect to the direction of rotation of the rotor blades, and respective ones of at least one of the rotor blades and the stator blades are formed so that the angles of orientation of the blades on a first surface of the blades facing the direction of rotation of the blades differ between the inlet port side of the blades and the outlet port side of the blades, and on a first side of the first surface of the blades closer to the inlet port the blades have a larger angle of orientation than on a second side of the first surface closer to the outlet port; wherein at least one side of respective ones of the blades facing the direction of rotation of the rotor blades has a plurality of surfaces each having different angles with respect to the direction of rotation of the rotor blades; and wherein the angles of orientation of the respective surfaces are in the range of 20° to 50° on the inlet port side of the blades, in a range of 10° to 40° on an intermediate portion of the blades, and in a range of 10° to 90° on the outlet port side of the blades.

2. A turbomolecular pump according to claim 1; wherein a difference between the angles in the plurality of surfaces is 5° or more.

3. A turbomolecular pump according to claim 1; wherein the angles of orientation of the respective surfaces are in the range of 10° to 40° on the outlet port side of the blades.

4. A turbomolecular pump according to claim 1; further comprising a plurality of stator blade spacers each for supporting one end of each of the stator blades and being stacked stepwise.

5. A turbomolecular pump comprising: a rotor shaft; a bearing for rotatably supporting the rotor shaft; a motor for rotationally driving the rotor shaft; a rotor body disposed on the rotor shaft; a plurality of rotor blades in a multistage arrangement in an axial direction of the pump from an inlet port side to an outlet port side thereof disposed on the rotor body for pumping a gas from the inlet port to the outlet port, the rotor blades each including a plurality of blades extending in a radial direction of the rotor body; and a plurality of stator blades in a multistage arrangement located between respective rotor blades, the stator blades each including a plurality of blades extending in the radial direction of the rotor body; wherein a sectional configuration of respective ones of at least one of the rotor blades and the stator blades in the axial direction of the pump is formed so that a first surface of each of the blades facing a direction of rotation of the rotor blades has a plurality of portions including a first surface portion on an inlet port side of the blade, a second surface portion on an outlet port side of the blade and an intermediate surface portion between the inlet and outlet port portions, the first surface portion having an angle of orientation in a range of 20° to 50° with respect to the direction of rotation of the rotor blades, the second surface portion having an angle of orientation in a range of 10° to 90° with respect to the direction of rotation of the rotor blades, and the intermediate surface portion having an angle of orientation in a range of 10° to 40° with respect to the direction of rotation of the rotor blades, and the first surface portion has a larger angle than the second surface portion.

6. A turbomolecular pump according to claim 5; wherein the angles of the first and second surface portions are at least 5° greater than the angle of the intermediate surface portion.

7. A turbomolecular pump according to claim 5; wherein a second surface of the blades opposite the first surface has the same angle of orientation with respect to the direction of rotation of the rotor blades as that of the first surface.

8. A turbomolecular pump according to claim 5; wherein a second surface of the blades opposite the first surface has a different angle of orientation with respect to the direction of rotation of the rotor blades from that of the first surface.

9. A turbomolecular pump according to claim 5; further comprising a thread groove pump section arranged on the outlet port side of the pump adjacent the rotor blades and stator blades.

10. A vacuum apparatus having a pump and a chamber connected to an inlet port of the pump; wherein the pump comprises the turbomolecular pump according to claim 5.

* * * * *